US009014577B2

(12) United States Patent
Valladares Estrada et al.

(10) Patent No.: US 9,014,577 B2
(45) Date of Patent: Apr. 21, 2015

(54) CARRIER DISPENSE RATE MEASUREMENT

(71) Applicant: Xerox Corporation, Norwalk, CT (US)

(72) Inventors: Rodolfo Enrique Valladares Estrada, Rochester, NY (US); Jerry Robert Boyle, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 220 days.

(21) Appl. No.: 13/716,457

(22) Filed: Dec. 17, 2012

(65) Prior Publication Data

US 2014/0169805 A1 Jun. 19, 2014

(51) Int. Cl.
*G03G 15/08* (2006.01)

(52) U.S. Cl.
CPC ..... *G03G 15/0849* (2013.01)

(58) Field of Classification Search
CPC ..... G03G 15/0839; G03G 15/0848; G03G 15/0865
USPC ..... 399/27
See application file for complete search history.

(56) References Cited

U.S. PATENT DOCUMENTS

| | | | | |
|---|---|---|---|---|
| 5,166,732 | A | 11/1992 | Fuji | |
| 5,305,064 | A | 4/1994 | Trott et al. | |
| 6,032,004 | A | 2/2000 | Mirabella, Jr. et al. | |
| 6,094,547 | A | 7/2000 | Hart | |
| 6,947,681 | B2 | 9/2005 | Ogata | |
| 7,106,995 | B2 | 9/2006 | Nagai et al. | |
| 7,747,182 | B2 | 6/2010 | Kato et al. | |
| 8,050,595 | B2 | 11/2011 | Wayman et al. | |
| 2006/0127110 | A1 | 6/2006 | Borton et al. | |
| 2007/0036566 | A1 | 2/2007 | Takeuchi et al. | |
| 2007/0098449 | A1 * | 5/2007 | Kadota et al. | 399/254 |

* cited by examiner

*Primary Examiner* — David Bolduc
*Assistant Examiner* — Barnabas Fekete
(74) *Attorney, Agent, or Firm* — Gibb & Riley, LLC

(57) ABSTRACT

A printing device (and associated method) comprises a carrier supply, one or more tubes operatively connected to the carrier supply, one or more developer stations operatively connected to the tubes, and at least two sensors connected to each of the tubes. The tubes supply a pulse of the carrier material ("slug") from the carrier supply to the developer stations. The sensors are positioned a known distance apart along a length of the tubes. The sensors detect the slug of the carrier material passing in the tubes. The processor determines the slug speed based on the timing difference of when the different sensors detect the slug. The processor determines the size of the slug based on the slug speed and determines the dispense rate of the carrier supply based on the size of the slug.

20 Claims, 5 Drawing Sheets

CARRIER DISPENSE RATE MEASUREMENT

BACKGROUND

Embodiments herein generally relate to printing devices and systems and more particularly to systems that determine the rate at which carrier particles used with toner are dispensed.

An electrostatic printing machine includes a photoconductive member that is charged to a substantially uniform potential to sensitize the surface thereof. An electrostatic latent image is placed on the photoconductive member corresponding to the informational areas contained within a document. After the electrostatic latent image is formed on the photoconductive member, bringing a developer material into proximal contact therewith develops the image.

Typically, the developer material comprises toner particles adhering tribo-electrically to magnetic carrier granules. This mixture is brought into contact with the photoconductive surface. The toner particles are attracted from the carrier granules to the latent image. The carrier granules are then returned to the developer housing where they can be resupplied with toner particles and where the new toner particles can be prepared with the appropriate tribo-electric charge.

Developer material has several properties including its electrical conductivity and its ability to properly charge toner. As the developer material ages its properties change, and when the material approaches the end of its useful life, copy quality deteriorates. By continuously adding additional new carrier granules to the developer housing, the rate of change of the developer material critical properties can be reduced or eliminated. The carrier replenishment system should provide good regulation of the input of carrier granules into the development unit.

SUMMARY

A printing device herein comprises a media supply maintaining print media, a media path operatively (meaning directly or indirectly) connected to the media supply, a printing engine operatively connected to the media path, and a processor operatively connected to the printing engine and controlling operations of the printing engine. The media path supplies the print media from the media supply to the printing engine. The printing engine places markings on the print media.

The printing engine comprises a carrier supply maintaining carrier material, one or more tubes operatively connected to the carrier supply, one or more developer stations operatively connected to the tubes, and at least two sensors operatively connected to each of the tubes. The tubes supply an accumulation of the carrier material (a "slug") from the carrier supply to the developer stations. Further, a pump creates a pressure amount within the tubes to move the accumulation of the carrier material from the carrier supply to the developer stations.

The sensors are positioned a known distance apart along the length of the tubes. The sensors detect the accumulation of the carrier material passing in the tubes (the carrier material has an electrical charge and the sensors can be current sensors that detect such an electrical charge). The processor determines the speed of the accumulation of the carrier material moving within the tubes based on the timing difference of when the different sensors detect the accumulation of the carrier material. The size of the accumulation of the carrier material affects the speed for a given pressure amount. Thus, the processor determines the size of the accumulation of the carrier material based on the pressure amount and speed, and determines the dispense rate of the carrier supply based on the size of the accumulation.

A method herein maintains carrier material within a carrier supply of a printing device, and supplies an accumulation of the carrier material from the carrier supply to a developer station of the printing device using a tube operatively connected between the carrier supply and the developer station. More specifically, this method creates a pressure amount within the tube to move the accumulation of the carrier material from the carrier supply to the developer station using a pump of the printing device.

Also, this method detects the accumulation of the carrier material passing in the tube using at least two sensors positioned a known distance apart along a length of the tube. Thus, this method can determine the speed of the accumulation of the carrier material moving within the tube based on the timing difference of when the different sensors detect the accumulation of the carrier material (using a processor of the printing device). Again, the size of the accumulation of the carrier material affects the speed for a given pressure amount. Thus, this method can determine the size of the accumulation of the carrier material based on the pressure amount and the speed, and can determine the dispense rate of the carrier supply based on the size of the accumulation (again using the processor).

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, the carrier replenishment system in a printer should provide good regulation of the input of carrier granules into the development unit. However, there is sometimes a decrease in grams per minute (GPM) of dispensed carrier observed in some printing machines over time. The GPM is the product of the pulses per minute (PPM) and the grams per pulses (GPP). The PPM is a constant value set during calibration in manufacturing; however, the GPP decreases over time. Carrier dispense is generally set to mitigate image quality (IQ) defects such as spitting, background, reload, low density, etc. If the carrier dispense rate decreases, it can affect the IQ and may cause an increase in service calls.

In view of this, the systems and methods herein use a second current sensor on the carrier dispense tube to measure the time the carrier slug takes to travel the known distance. Since the carrier slug is transported using a constant pressure from a pump, the time it takes to travel between sensors can be correlated to its mass. With the mass of the carrier slug known, a closed loop feedback controller compensates the loss of grams per pulse with increases in the pulses per minute, thus keeping carrier dispense rate (GPM) constant.

Figure 1:
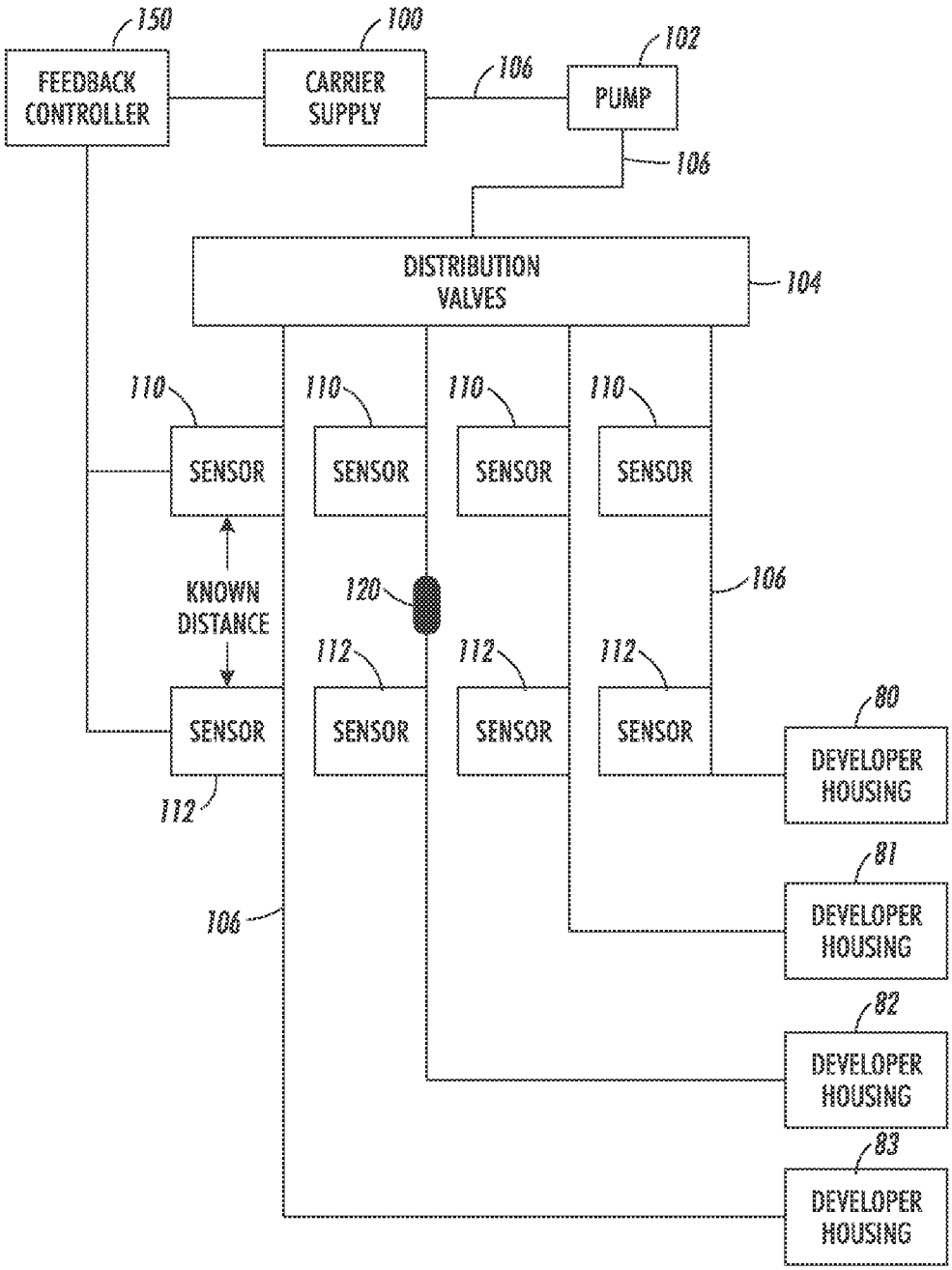
FIG. 1 is a schematic diagram of a device according to embodiments herein.

As shown in FIG. 1 a portion of a printing engine (a more complete description of a printing device is presented below with respect to FIG. 5) includes a carrier supply (e.g., hopper) 100 maintaining carrier material, one or more tubes 106 operatively (meaning directly or indirectly) connected to the carrier supply 100, one or more developer stations 80-83 operatively connected to the tubes 106, and at least two sensors 110, 112 operatively connected to each of the tubes 106. In one example, distribution valves 104 or any other similar structure can control the dispensing of the carrier to the tubes 106. Further, a controller (for example a feedback controller) 150 is connected to each of the sensors 110, 112. Note that some of the connections between elements in the drawings (such as some of the connections between the sensors 110, 112 and the controller 150) have not been shown to avoid clutter in the drawings.

The tubes 106 supply 100 an accumulation 120 of the carrier material (sometimes referred to as a "slug" of carrier material) from the carrier supply 100 to the developer stations 80-83. Further, a pump 102 creates pressure within the tubes 106 to move the accumulation 120 of the carrier material from the carrier supply 100 to the developer stations 80-83.

The sensors 110, 112 are positioned a known distance apart along the length of the tubes 106. The sensors 110, 112 detect the accumulation 120 of the carrier material passing in the tubes 106 (the carrier material has an electrical charge and the sensors 110, 112 can be current sensors that detect such an electrical charge, or other types of sensors such as optical sensors, contact sensors, acoustic sensors, etc.).

Figure 2:
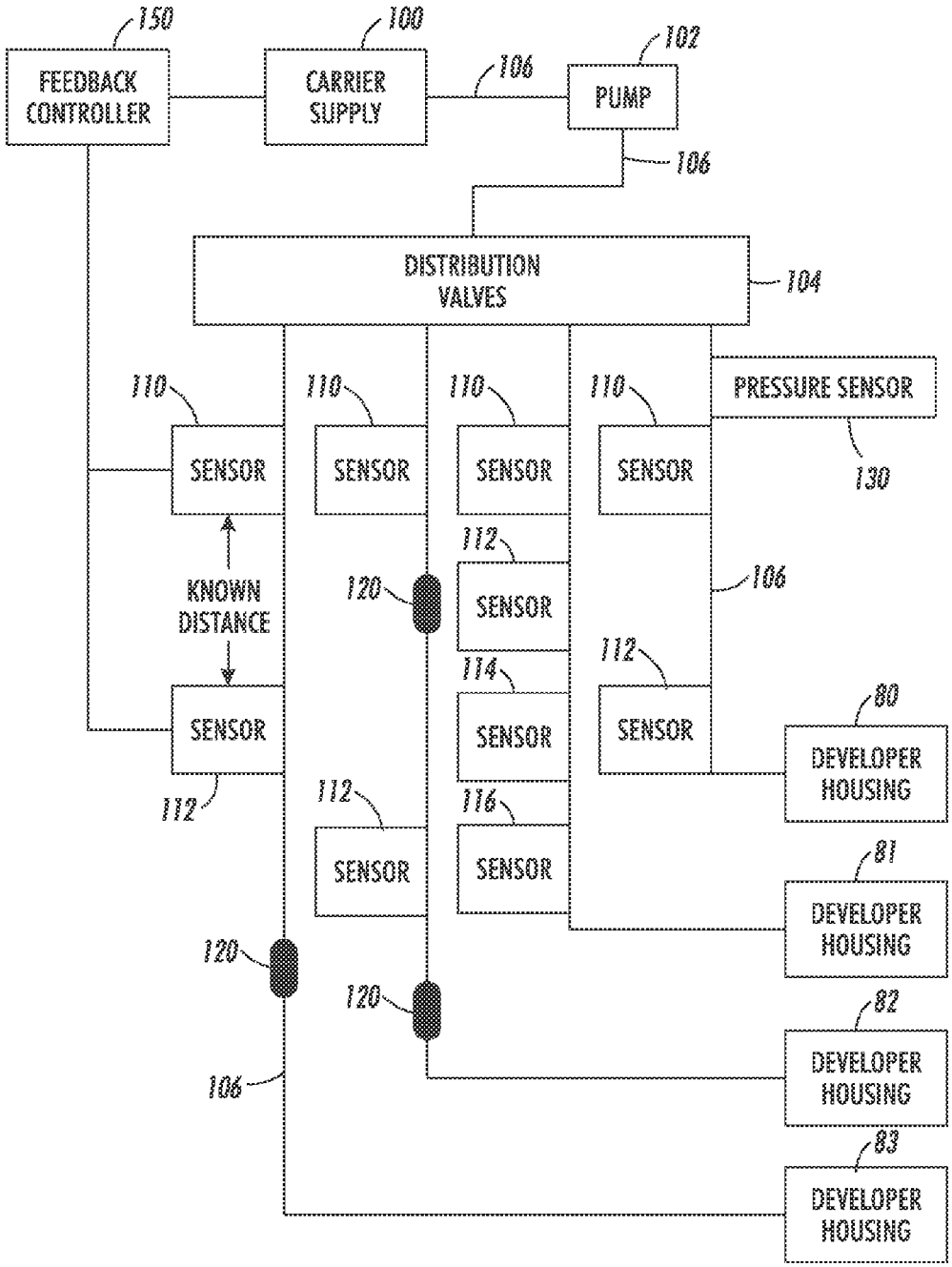
FIG. 2 is a schematic diagram of a device according to embodiments herein.

As shown in FIG. 2, various alternative structures herein can include more than two sensors (e.g., sensors 114, 116) on the tubes 106, can include different spacing of sensors among the tubes 106, can include different numbers of sensors among the tubes 106, etc. Further, as shown in FIG. 2, multiple accumulations 120 of the carrier material can be simultaneously traveling in the tubes 106 at any given time. One or more pressure sensors 130 (one of which is illustrated) can also be used to sense the pressure within the tubes 106

The processor (discussed below) determines the speed of the accumulation 120 of the carrier material moving within the tubes 106 based on the timing difference of when the different sensors 110, 112 detect the accumulation 120 of the carrier material. In other words, one sensor 110 will detect the beginning (or middle or end) of accumulation 120, then some time later another sensor 112 will detect the same point (e.g., beginning, middle, or end) of the same accumulation as the accumulation 120 travels through the tube 106. The time the accumulation 120 takes to travel the distance between the sensors determines the speed of the accumulation 120.

The size of the accumulation 120 of the carrier material affects the speed of the accumulation 120 of the carrier material for a given pressure amount. Thus, the processor determines the size of the accumulation 120 of the carrier material based on the pressure amount and speed of the accumulation 120 of the carrier material, and determines the dispense rate of the carrier supply 100 based on the size of the accumulation 120.

The density of the accumulation 120 of the carrier material remains essentially constant at a given pressure within the tube 106 and, therefore, the size of the accumulation represents a specific amount (in terms of weight, mass, volume, etc.) of the carrier material, allowing the amount of carrier material dispensed by the carrier supply 100 and distribution valves 104 to be known with high accuracy.

Thus, in one example, as a machine ages, the size of the accumulations 120 that are dispensed by the carrier supply 100 may decrease over time (because of component wear, foreign matter accumulation, etc.). If a large number of accumulations 120 are measured over time to be moving at a (higher than expected) average speed that indicates that the carrier supply 100 is dispensing smaller sized accumulations (containing less carrier particles each), the controller can increase the pulses per minute to cause more accumulations 120 to be delivered to the developer housings 80-83 over time. By delivering more of the smaller sized accumulations 120 over time, the controller thereby compensates for the smaller sized accumulations 120 that are being dispensed.

As noted above, carrier dispense helps maintain image quality. If there is a decrease in the carrier dispense rate, image quality will be affected, which may result in more service calls. Carrier dispense rate can be measured by the grams per minute (GPM) the developer housing 80-83 receives periodically. The carrier is stored in a hopper 100 that can be common to all housings, but each housing can contain an individual carrier line 106. One of the sensors (e.g., 112) can be in place right before each one of the housings, telling the machine a carrier slug goes by. This sensor 112 can measure the charge of the passing carrier.

As shown in FIGS. 1 and 2, the devices and methods herein use a second sensor (110) upstream at set distance from the first sensor 112 to measure the time the carrier slug 120 takes to cover the known distance. Since the pump 102 that pressurizes the hopper 100 and moves the slug is fairly constant for a given machine, the devices and methods herein relate the travelled time to the size of the slug. Pressure might differ between machines, but this pressure can be input at time of manufacture or can be measured with a pressure sensor 130. With a constant travelled distance, and a constant pressure moving the slug 120, any recorded travel time difference will be caused by a different sized slug 120. A bigger slug will weigh more and contain more carrier material, which will take the pump 102 longer to transport it down the line 106; and if the slug 120 is bigger it also has a bigger volume, thus creating more friction against the walls of the line 106.

Figure 3:
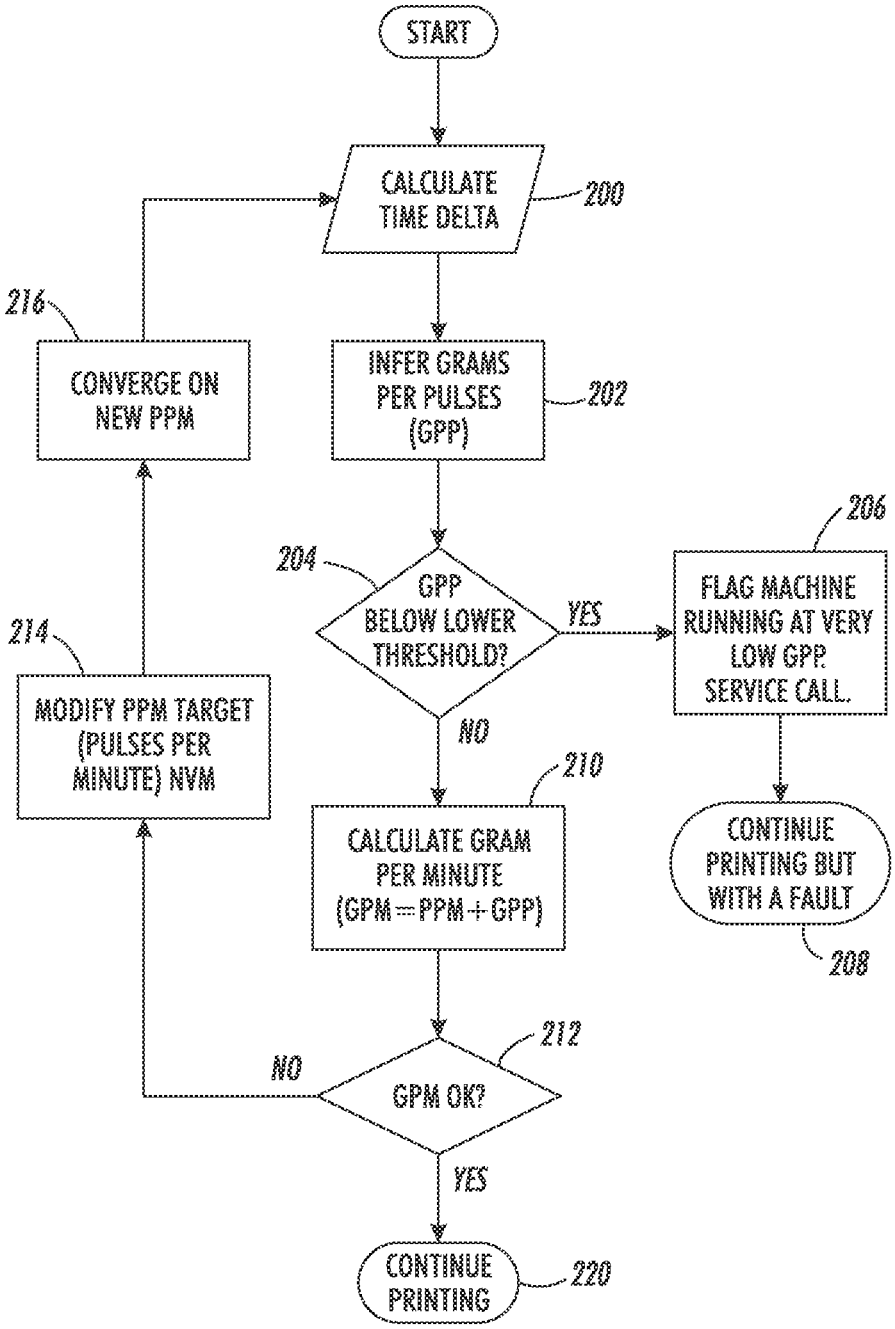
FIG. 3 is a flow diagram illustrating various embodiments herein.

The grams per pulses (GPP) can be averaged from a series of time difference measurements accumulated over time, and the feedback controller 150 can keep the carrier dispense constant. FIG. 3 illustrates one example of the processing that the feedback controller 150 can perform. As shown in item 200 in FIG. 3, the controller 150 calculates the time difference between when an individual accumulation of carrier material passes the first sensor and the second sensor. From this, the controller 150 infers the grams per pulse (GPP) by determining the size of the accumulation (based on the speed of the accumulation, as discussed above) in item 202. If the GPP is below a given threshold that is lower that the machine can compensate with the pulses per minute (PPM) set point, item 204 directs the flow to item 206, which produces a flag indicating that the machine is running at a very low GPP (and initiates a service call). As shown in item 208, printing can continue but it will do so under a fault condition.

If the GPP is above the given threshold, item 204 directs the flow to item 210, which calculates the grams per minute (GPM). More specifically, in item 210, the PPM is multiplied by the GPP to produce the GPM. If the GPM is within acceptable limits, item 212 directs processing to item 220 where printing operations are continued normally. If the GPM is not within acceptable limits, item 212 directs processing to item 214, which modifies the PPM target within the nonvolatile memory (NVM) of the printing device. Therefore, in item 216, the controller 150 converges on a new PPM which is utilized from that point forward to provide the updated carrier dispense amount.

Therefore, as shown in FIGS. 1-3, the devices herein use multiple sensors to calculate the time a carrier slug takes to travel a distance, thus being able to correlate to the mass of the slug and then calculate grams per pulse (GPP). This allows the devices herein to monitor if a specific machine has very low GPP and alert service. Further, the devices herein use a feedback control loop to adjust pulses per minute (PPM) according to grams per pulse (GPP) to keep the grams per minute constant (GPM). This results in a reduced number of service calls due to image quality defects caused by very low carrier dispense rates, increased reliability of the printing devices, and increased image quality overall.

Figure 4:
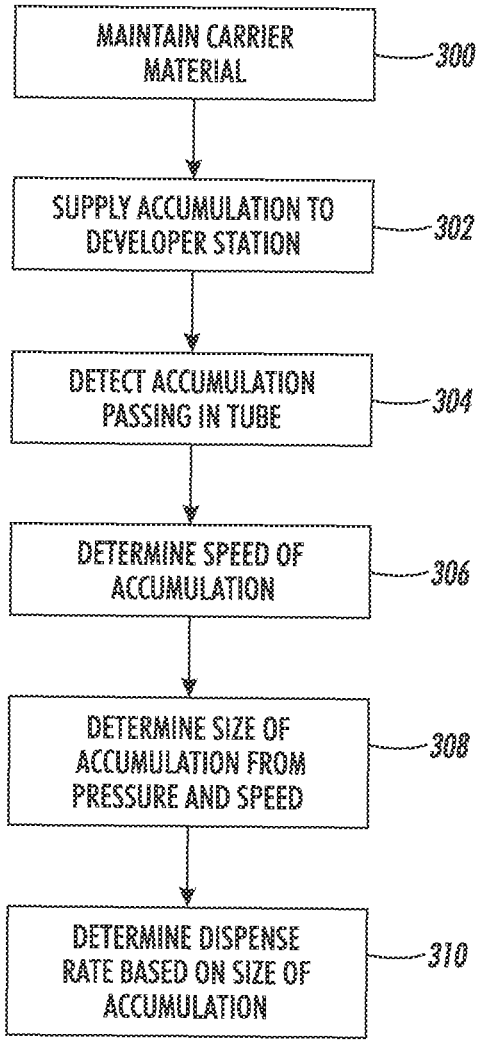
FIG. 4 is a flow diagram illustrating various embodiments herein.

FIG. 4 is flowchart illustrating an exemplary method herein. In item 300, this method maintains carrier material within a carrier supply of a printing device. This method supplies an accumulation of the carrier material from the carrier supply to a developer station of the printing device using a tube operatively connected between the carrier supply and the developer station in item 302. More specifically, in item 302 this method creates a pressure amount within the tube to move the accumulation of the carrier material from the carrier supply to the developer station using a pump of the printing device.

Also, as shown in item 304 this method detects the accumulation of the carrier material passing in the tube using at least two sensors positioned a known distance apart along the length of the tube. Thus, in item 306 this method can determine the speed of the accumulation of the carrier material moving within the tube based on the timing difference of when the different sensors detect the accumulation of the carrier material (using a processor of the printing device). Again, the size of the accumulation of the carrier material affects the speed for a given pressure amount. Thus, in item 308 this method can determine the size of the accumulation of the carrier material based on the pressure amount and the speed. The method then determines the dispense rate of the carrier supply based on the size of the accumulation (again using the processor) in item 310.

Figure 5:
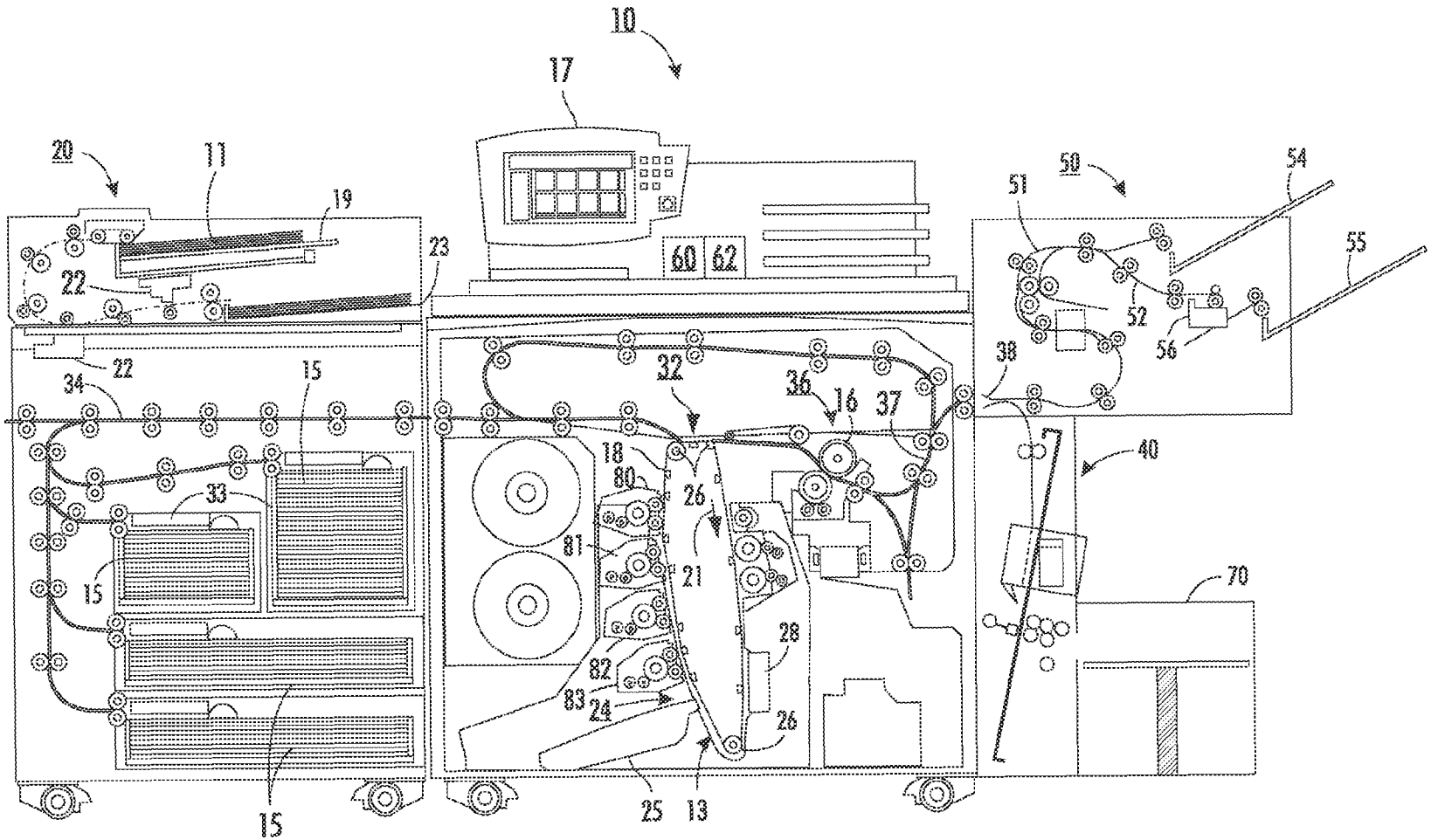
FIG. 5 is a side-view schematic diagram of a device according to embodiments herein.

Referring to the FIG. 5 a printing machine 10 is shown that includes the structures shown above in FIGS. 1-3. An automatic document feeder 20 (ADF) can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile (non-transitory, tangible) storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing stations 80-83 (one for each color toner (e.g. cyan, yellow, magenta, black (CYMK)) color toners), and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electro-statically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices that contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 5 is only one example and the embodiments herein are equally applicable to other types of printing devices that may include fewer components or more components. For example, while a limited number of printing engines and paper paths are illustrated in FIG. 5, those ordinarily skilled in the art would understand that many more paper paths and additional printing engines could be included within any printing device used with embodiments herein. In such a computerized (printing) device 10, the processor 60 in the control panel 17 can perform the processing shown in FIGS. 3 and 4.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the embodiments herein cannot be implied or imported from any above example as limitations to any particular order, number, position, size, shape, angle, color, or material.

What is claimed is:

1. A printing device comprising:
a carrier supply maintaining carrier material;
a tube operatively connected to said carrier supply;
a developer station operatively connected to said tube;
at least two sensors operatively connected to said tube; and
a processor operatively connected to said sensors,
said tube supplying an accumulation of said carrier material from said carrier supply to said developer station,
said sensors being positioned a distance apart along a length of said tube,
said sensors detecting said accumulation of said carrier material passing in said tube,
said processor determining a speed of said accumulation of said carrier material moving within said tube based on a timing difference of when said sensors detect said accumulation of said carrier material,
said processor determining a size of said accumulation of said carrier material based on said speed and on a pressure amount within said tube, and
said processor determining a dispense rate of said carrier supply based on said size of said accumulation.

2. The printing device according to claim 1, further comprising a pump creating said pressure amount within said tube to move said accumulation of said carrier material from said carrier supply to said developer station.

3. The printing device according to claim 2, said size of said accumulation of said carrier material affecting said speed for a constant pressure amount.

4. The printing device according to claim 1, said processor determining said dispense rate of said carrier supply based on an amount of said carrier material said size of said accumulation represents.

5. The printing device according to claim 1, said carrier material having an electrical charge and said sensors comprising current sensors detecting said electrical charge.

6. A printing device comprising:
a carrier supply maintaining carrier material;
tubes operatively connected to said carrier supply;
developer stations operatively connected to said tubes;
at least two sensors operatively connected to each of said tubes; and
a processor operatively connected to said sensors,
said tubes supplying an accumulation of said carrier material from said carrier supply to said developer stations,
said sensors being positioned a distance apart along a length of said tubes,
said sensors detecting said accumulation of said carrier material passing in said tubes,
said processor determining a speed of said accumulation of said carrier material moving within said tubes based on a timing difference of when said sensors detect said accumulation of said carrier material,
said processor determining a size of said accumulation of said carrier material based on said speed and on a pressure amount within said tube, and
said processor determining a dispense rate of said carrier supply based on said size of said accumulation.

7. The printing device according to claim 6, further comprising a pump creating said pressure amount within said tubes to move said accumulation of said carrier material from said carrier supply to said developer stations.

8. The printing device according to claim 7, said size of said accumulation of said carrier material affecting said speed for a constant pressure amount.

9. The printing device according to claim 6, said processor determining said dispense rate of said carrier supply based on an amount of said carrier material said size of said accumulation represents.

10. The printing device according to claim 6, said carrier material having an electrical charge and said sensors comprising current sensors detecting said electrical charge.

11. A printing device comprising:
a media supply maintaining print media;
a media path operatively connected to said media supply;
a printing engine operatively connected to said media path; and
a processor operatively connected to said printing engine and controlling operations of said printing engine,
said media path supplying said print media from said media supply to said printing engine,
said printing engine placing markings on said print media,
said printing engine comprising a carrier supply maintaining carrier material, a tube operatively connected to said carrier supply, a developer station operatively connected to said tube, and at least two sensors operatively connected to said tube and to said processor,
said tube supplying an accumulation of said carrier material from said carrier supply to said developer station,
said sensors being positioned a distance apart along a length of said tube,
said sensors detecting said accumulation of said carrier material passing in said tube,
said processor determining a speed of said accumulation of said carrier material moving within said tube based on a timing difference of when said sensors detect said accumulation of said carrier material, said processor determining a size of said accumulation of said carrier material based on said speed and on a pressure amount within said tube, and said processor determining a dispense rate of said carrier supply based on said size of said accumulation.

12. The printing device according to claim 11, further comprising a pump creating said pressure amount within said tube to move said accumulation of said carrier material from said carrier supply to said developer station.

13. The printing device according to claim 12, said size of said accumulation of said carrier material affecting said speed for a constant pressure amount.

14. The printing device according to claim 11, said processor determining said dispense rate of said carrier supply based on an amount of said carrier material said size of said accumulation represents.

15. The printing device according to claim 11, said carrier material having an electrical charge and said sensors comprising current sensors detecting said electrical charge.

16. A method comprising:

maintaining carrier material within a carrier supply of a printing device;

supplying an accumulation of said carrier material from said carrier supply to a developer station of said printing device using a tube operatively connected between said carrier supply and said developer station;

detecting said accumulation of said carrier material passing in said tube using at least two sensors positioned a distance apart along a length of said tube;

determining a speed of said accumulation of said carrier material moving within said tube based on a timing difference of when said sensors detect said accumulation of said carrier material using a processor of said printing device;

determining a size of said accumulation of said carrier material based on said speed and on a pressure amount within said tube using said processor; and determining a dispense rate of said carrier supply based on said size of said accumulation using said processor.

17. The method according to claim 16, further comprising creating said pressure amount within said tube to move said accumulation of said carrier material from said carrier supply to said developer station using a pump of said printing device.

18. The method according to claim 17, said size of said accumulation of said carrier material affecting said speed for a constant pressure amount.

19. The method according to claim 16, said determining of said dispense rate of said carrier supply being based on an amount of said carrier material said size of said accumulation represents.

20. The method according to claim 16, said carrier material having an electrical charge and said sensors comprising current sensors detecting said electrical charge.

* * * * *